US009727006B2

(12) United States Patent
Honma

(10) Patent No.: US 9,727,006 B2
(45) Date of Patent: Aug. 8, 2017

(54) IMAGE FORMING APPARATUS, IMAGE FORMING METHOD, AND NON-TRANSITORY COMPUTER-READABLE RECORDING MEDIUM STORING IMAGE FORMATION PROGRAM

(71) Applicant: KONICA MINOLTA, INC., Chiyoda-ku, Tokyo (JP)

(72) Inventor: Mikimasa Honma, Mizuho-machi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/245,822

(22) Filed: Aug. 24, 2016

(65) Prior Publication Data

US 2017/0075260 A1 Mar. 16, 2017

(30) Foreign Application Priority Data

Sep. 11, 2015 (JP) ..... 2015-179746

(51) Int. Cl.
*G03G 15/00* (2006.01)
*G03G 15/16* (2006.01)

(52) U.S. Cl.
CPC ..... *G03G 15/161* (2013.01); *G03G 15/5033* (2013.01); *G03G 15/5041* (2013.01)

(58) Field of Classification Search
CPC ..... G03G 15/161; G03G 15/5033; G03G 15/5041
See application file for complete search history.

(56) References Cited

U.S. PATENT DOCUMENTS 7,228,083 B2 * 6/2007 Iwakawa ..... G03G 15/5062 399/15
2010/0247124 A1 * 9/2010 Aoki ..... G03G 15/161 399/49

FOREIGN PATENT DOCUMENTS

JP 2012-230335 A 11/2012

* cited by examiner

*Primary Examiner* — Hoang Ngo
(74) *Attorney, Agent, or Firm* — Buchanan Ingersoll & Rooney PC

(57) ABSTRACT

An image formation unit that forms an image on a transfer medium, a conveyance unit that conveys the transfer medium, a control unit that controls formation of the image and conveyance of the transfer medium are provided. The control unit has a sheet gap image forming function of forming a predetermined toner image in a sheet gap between the transfer media conveyed by the conveyance unit. When the transfer medium is conveyed, the control unit acquires information of a tilt angle on a conveyance surface of the transfer medium conveyed to the image formation unit, calculates a sheet gap between the transfer media based on the tilt angle, determines whether or not a toner image of a required amount is able to be formed in the sheet gap when performing the sheet gap image forming function, and controls formation of the sheet gap image based on the determination result.

17 Claims, 11 Drawing Sheets

IMAGE FORMING APPARATUS, IMAGE FORMING METHOD, AND NON-TRANSITORY COMPUTER-READABLE RECORDING MEDIUM STORING IMAGE FORMATION PROGRAM

The present U.S. patent application claims a priority under the Paris Convention of Japanese patent application No. 2015-179746 filed on Sep. 11, 2015, the entirety of which is incorporated herein by references.

BACKGROUND OF THE INVENTION

Field of the Invention

The present invention relates to an image formation apparatus, an image formation method, and a non-transitory computer-readable recording medium storing an image formation program, capable of forming a sheet gap image with a predetermined object in a sheet gap between transfer media on which an image is formed.

Description of the Related Art

In an image formation apparatus for printing an image on a sheet with use of an electrophotographic system, there is a case where a toner image is drawn on an image bearing member such as an intermediate transfer belt in a space between sheets, to stabilize an image. As one type of a toner image, there is an image correction patch. Specifically, a patch is printed on a sheet, and the patch of an output image is detected by a color density sensor or the like and is compared with print base data. If there is a difference between them, the printing density or the like is corrected to form an image. Further, a toner image formed on an image bearing member may be read by a density sensor or the like and used for calibration of the density sensor, for example. There is also a toner consumption image for disposing old toner.

Regarding such toner images, it is possible to form patches of different purposes simultaneously in a space between sheets, and shapes of the toner images are set so as to be formed in a space between sheets.

Japanese Patent Laid-Open No. 2012-230335 proposes an image formation apparatus in which a formation region, on which toner patterns are formed, is determined to be either an end region in a main scanning direction where a print image is not formed or a space region between adjacent print images, of a region on a transfer belt. Then, a predetermined number of reference toner patterns are formed dividedly in the end region or the space region determined to be the formation region according to the size of the end region or the space region.

However, in the case of conveying sheets, there is a case where a sheet is fed in a tilted manner when it is fed from a sheet feed tray, or a sheet is caused to be tilted when it moves from the sheet feed tray to an image formation unit. In that case, a sheet is introduced to the image formation unit in a tilted state. When a sheet is conveyed in a tilted manner, a space between the rear end of a previous sheet and the front end of the subsequent sheet (hereinafter referred to as a sheet gap) is decreased. As such, when it is attempted to form a sheet gap image in a sheet gap, there is a case where a sheet gap image of a required amount cannot be formed in the sheet gap.

Further, when an image is formed in a state where a sheet is tilted, the image is drawn on the sheet in a tilted manner. In order to prevent it, there is a function of forming an image by turning the image to be written on the image bearing member according to the tilt of the sheet to thereby conform the sheet to the image data. However, when turning correction is made and the drawing region (image signal) of the image data is extended, there is a possibility that the timing of writing the toner image deviates so that the designed pattern cannot be drawn in the sheet gap, whereby the image may overlap the next image.

SUMMARY OF THE INVENTION

The present invention has been made with the background of such a situation. An object of the present invention is to provide an image formation apparatus, an image formation method, and a non-transitory computer-readable recording medium storing an image formation program, capable of forming a sheet gap image of a required amount in a sheet gap even in the case of a tilted transfer medium.

To achieve at least one of the abovementioned objects, according to an aspect, an image formation apparatus reflecting one aspect of the present invention includes:

an image formation unit that forms an image on a transfer medium, a conveyance unit that conveys the transfer medium, and a control unit that controls formation of the image and conveyance of the transfer medium.

The control unit has a sheet gap image forming function of forming a predetermined sheet gap image in a sheet gap between the transfer media conveyed by the conveyance unit, and when the transfer medium is conveyed, the control unit acquires information of a tilt angle on a conveyance surface of the transfer medium conveyed to the image formation unit, and based on the tilt angle, calculates a sheet gap between the transfer media, and when performing the sheet gap image forming function, determines whether or not the sheet gap image of a required amount is able to be formed in the sheet gap.

In the image formation apparatus according to the abovementioned aspect, it is preferable that the control unit controls formation of the sheet gap image based on a result of the determination.

In the image formation apparatus according to the abovementioned aspect, it is preferable that the control unit has an image turning correction function of forming an image to be written, to be formed on the transfer medium, on the transfer medium by tilting the image according to the tilt angle of the transfer medium.

In the image formation apparatus according to the abovementioned aspect, it is preferable that the control unit determines timing to start writing of the sheet gap image according to a state where an output signal of the image, to be formed on the transfer medium, is turned off.

In the image formation apparatus according to the abovementioned aspect, it is preferable that, when the control unit determines, in the determination, that the sheet gap image of the required amount is not able to be formed in the sheet gap, the control unit forms the sheet gap image of an amount capable of being formed in the sheet gap or less in the sheet gap, and forms the sheet gap image of at least an amount incapable of being formed in the sheet gap, in a next or subsequent sheet gap.

In the image formation apparatus according to the abovementioned aspect, it is preferable that, when the control unit determines, in the determination, that the sheet gap image of the required amount is not able to be formed in the sheet gap, the control unit forms the sheet gap image in a next or subsequent sheet gap where the sheet gap image of the required amount is able to be formed.

In the image formation apparatus according to the abovementioned aspect, it is preferable that, when the control unit determines, in the determination, that the sheet gap image of the required amount is not able to be formed in the sheet gap, the control unit determines whether there is a transfer medium, same as the transfer medium being fed, in another sheet feed device, and whether the sheet gap image of the required amount is able to be formed in a gap provided by the other sheet feed device, and if it is possible, the control unit allows a transfer medium immediately before forming the sheet gap image to be fed from the other sheet feed device.

In the image formation apparatus according to the abovementioned aspect, it is preferable that the control unit acquires information of a tilt angle, registered in advance, of a transfer medium to be conveyed.

In the image formation apparatus according to the abovementioned aspect, it is preferable that the image formation apparatus further includes a tilt detection unit that detects a tilt angle of the sheet to be conveyed, and the control unit acquires information of the tilt angle based on a detection result by the tilt detection unit.

In the image formation apparatus according to the abovementioned aspect, it is preferable that the sheet gap image is a toner consumption patch or/and a correction patch.

In the image formation apparatus according to the abovementioned aspect, it is preferable that the control unit calculates a sheet gap between the transfer media based on the tilt angle for each type of a transfer medium or each feed device that feeds a transfer medium.

To achieve at least one of the abovementioned objects, according to an aspect, an image formation method reflecting one aspect of the present invention includes:

acquiring information of a tilt angle on a conveyance surface of a transfer medium conveyed for image formation, calculating a sheet gap between the transfer media based on a space between sheets of the transfer media set in advance, and the tilt angle, and in sheet gap image formation of forming a predetermined sheet gap image between the sheets of the transfer media, determining whether or not the sheet gap image of a required amount is able to be formed in the sheet gap.

To achieve at least one of the abovementioned objects, according to an aspect, a non-transitory computer readable recording medium storing an image formation program reflecting one aspect of the present invention is a non-transitory computer-readable recording medium storing an image formation program to be executed by a control unit that controls a conveyance unit to convey a transfer medium and controls an image formation unit to form an image on the transfer medium. The image formation program includes a sheet gap image formation step of forming a predetermined sheet gap image in a sheet gap between the transfer media by the image formation unit, a step of acquiring information of a tilt angle on a conveyance surface of the transfer medium conveyed by the conveyance unit and on which the image is formed, a step of calculating the sheet gap between the transfer media based on the tilt angle, and a determination step of determining whether or not the sheet gap image of a required amount is able to be formed in the sheet gap in the sheet gap image formation step.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

BRIEF DESCRIPTION OF THE PREFERRED EMBODIMENTS

Hereinafter, an embodiment of the present invention will be described with reference to the drawings. However, the scope of the invention is not limited to the illustrated examples.

Next, embodiments of the present invention will be described based on the accompanying drawings.

Figure 1:
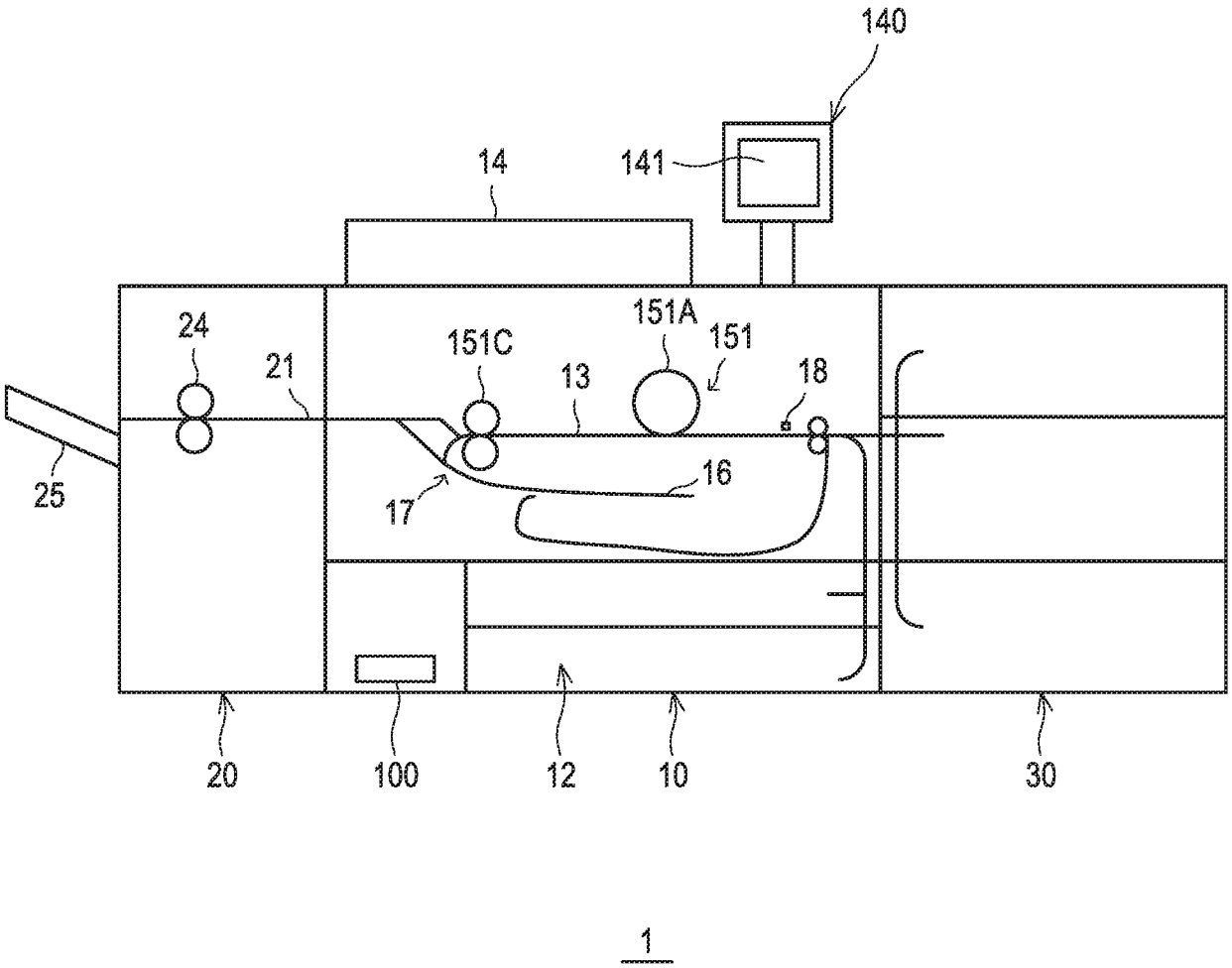
FIG. 1 illustrates a schematic configuration of an image formation apparatus according to an embodiment of the present invention.

An image formation apparatus 1 shown in FIG. 1 is configured such that an image formation apparatus main body 10, which performs image formation, and a post processing device 20, which performs post processing of a sheet on which an image is formed by the image formation apparatus main body 10, are connected with each other mechanically and electrically, and further, a large-capacity sheet feed tray 30 is linked to the upstream side of the image formation apparatus main body 10 electrically and mechanically.

However, as the present invention, the connection configuration of the image formation apparatus is not limited to this. Further, the post processing device may be one not included in the image formation apparatus. Alternatively, the post processing device can be built in the image formation apparatus.

On the upper side of the image formation apparatus main body 10, a document feeder (DF) 14, constituting a part of a document reading unit, is provided. Regarding a document fed by the document feeder (DF) 14, the image thereof can be read by a scanner unit 130 (shown in FIG. 2). It should be noted that a document can be read by a platen glass not shown.

Further, on the upper side of the image formation apparatus main body 10, an operation unit 140 is provided at a location where the platen glass is not placed. The operation unit 140 is provided with an LCD 141. The LCD 141 is configured of a touch panel, capable of displaying an operation by an operator and information. The LCD 141 is used as both the display unit and the operation unit. It should be noted that the operation unit can be configured of a mouse or a tablet, independent of the display unit. Further, the LCD 141 may be a movable one.

On the lower side of the image formation apparatus main body 10, a plurality of sheet feed trays 12 (two stages in the drawing) are arranged, in which sheets are stored and can be fed. A sheet corresponds to a transfer medium of the present invention. The type of a transfer medium is not limited particularly, and it may not be paper.

Inside the image formation apparatus main body 10, a conveyance path 13 for conveying a sheet, fed from any of the sheet feed trays 12, is provided, and an image formation unit 151 is provided in the middle of the conveyance path 13.

The conveyance path 13, on the upstream side of the image formation unit 151, is provided with a sheet tilt detection unit 18 which detects a tilt on the conveying surface of a sheet being conveyed toward the image formation unit 151. The configuration of the sheet tilt detection unit 18 is not limited particularly. Any known configuration can be used if it is able to detect a tilt of a sheet. For example, it is possible to arrange two optical sensors in a width direction of a sheet and detect a tilt of a sheet from a result of detecting the front end of the sheet by the two optical sensors. Meanwhile, the present invention may not include the sheet tilt detection unit 18.

The image formation unit 151 includes a photoreceptor 151A, and a charging unit, a developing unit, a transfer unit, not shown, and an LD 151B (shown in FIG. 2), which are arranged around the photoreceptor 151A. Further, the conveyance path 13 on the downstream side of the photoreceptor 151A is provided with a fixing device 151C.

On the downstream side of the fixing device 151C, the conveyance path 13 extends and branches to a conveyance path 13 on the downstream side extending straight, and a reverse conveyance path 17 having a reverse conveying unit 16.

In the image formation unit 151, before writing an image, a surface of the photoreceptor 151A is charged uniformly by the charging unit, and the photoreceptor 151A, in which the surface is charged uniformly, is irradiated with semiconductor laser by the LD 151B, whereby an electrostatic latent image is formed on the photoreceptor 151A. The developing unit develops the electrostatic latent image, formed on the photoreceptor 151A by the LD 151B, using a toner member. Through the developing process, an image is formed on the photoreceptor 151A. The transfer unit transfers the image on the photoreceptor 151A to a sheet conveyed from the sheet feed tray 12 or the large-capacity sheet feed tray 30. The sheet on which the image is transferred is separated from the photoreceptor 151A, and is conveyed to the fixing device 151C. The toner member remaining on the photoreceptor 151A is removed by a cleaning unit not shown.

The fixing device 151C heats the conveyed sheet to thereby fix the image transferred on the surface side of the sheet as an output image. The sheet, on which the fixing process is performed, may be directly conveyed to the post processing device 20 through the conveyance path 13, or the front and back sides thereof are reversed by the reverse conveying unit 16, and then the sheet flows back to the upstream side of the image formation unit 151 and an image is formed on the back surface of the sheet, in which the front and back sides are reversed, by the image formation unit 151, whereby duplex printing can be realized. It should be noted that, after conveying a sheet to the reverse conveyance path 17 and reversing the sheet by the reverse conveying unit 16, it is possible not to convey it to the image formation unit 151 but to return it to the conveyance path 13 for conveyance. The conveyance path 13 is connected with a conveyance path 21 of the post processing device 20 on the downstream side.

The image formation apparatus main body 10 also includes an overall control block unit 100 which controls the image formation apparatus 1.

The post processing device 20 is capable of performing post processing on a sheet on which an image is formed. The content of post processing is not limited particularly. Various types of post processing such as stapling, punching, and folding can be performed, and multiple types of post processing can also be performed.

Figure 2:
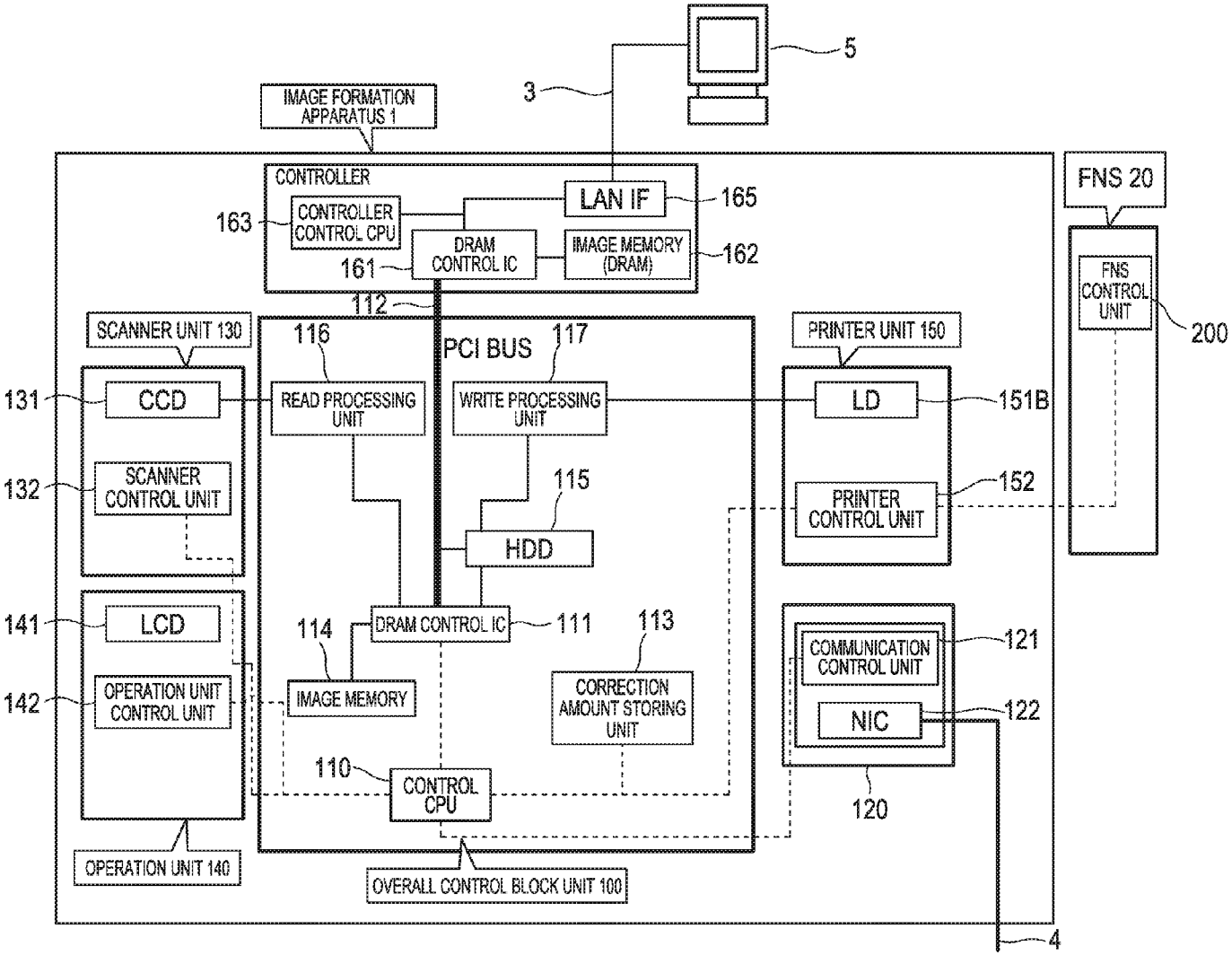
FIG. 2 illustrates function blocks of the image formation apparatus according to the embodiment of the present invention.

Next, control blocks including in the image formation apparatus 1 will be described based on FIG. 2. A large-capacity sheet feed tray is omitted in the control blocks.

The image formation apparatus 1 includes, as main components, the overall control block unit 100, a scanner unit 130, the operation unit 140, a printer unit 150, and a controller 160 which processes image data input and output between it and an external device (for example, a terminal (PC) 5) via a LAN 3.

The image formation apparatus 1 is connected with a management device, not shown, which manages the image formation apparatus via a network 4.

The overall control block unit 100 is provided with a control CPU 110, and the control CPU 110 is connected with a DRAM control IC 111 and a correction amount storing unit 113.

The correction amount storing unit 113 includes a nonvolatile memory or the like, and stores a correction amount for adjusting a turn of an image to be written in the image formation unit according to the tilt of a sheet.

The control CPU 110 controls the entire image formation apparatus 1, grasps a state of the entire image formation apparatus 1, and receives reading results of the image formation unit 151, the conveyance path 13, and the sheet tilt detection unit 18. The control CPU 110 includes a ROM, a nonvolatile memory, and the like, and a program stored in the ROM is executed by the control CPU 110. The control CPU 110 and the correction amount storing unit 113 function as a control unit of the present invention.

The scanner unit 130 includes a CCD 131 which performs optical reading, and a scanner control unit 132 which controls the entire scanner unit 130. The scanner control unit 132 is connected with the control CPU 110, and is controlled by the control CPU 110. It should be noted that the scanner control unit 132 can be configured of a CPU, a program for operating it, and the like. Image information read by the CCD 131 is applied with data processing by the read processing unit 116. The read processing unit 116 is connected with a DRAM control IC 111, and image data, on which data processing is performed by the read processing unit 116, is transmitted to the DRAM control IC 111.

The operation unit 140 includes the touch-panel LCD 141 and an operation unit control unit 142. The LCD 141 and the operation unit control unit 142 are connected with each other, and the operation unit control unit 142 and the control CPU 110 are connected with each other in a manner capable of performing serial communication. With this configuration, the operation unit 140 is controlled by the control CPU 110. It should be noted that the operation unit control unit 142 can be configured of a CPU, a program for operating it, and the like.

The DRAM control IC 111 is connected with an image memory 114. In the image memory 114, image information acquired by the scanner unit 130, image information and print conditions acquired through the LAN 3 or the like, file information, and the like are stored. As described above, the image memory 114 is a memory region for image information, print conditions, and file information, and stores information of a printing job.

Further, the DRAM control IC 111 is connected with a HDD 115 (hard disk), and is able to store data in a nonvolatile manner. In the HDD 115, image information acquired by the scanner unit 130, image information generated by the terminal (PC) 5 connected with the controller 160, and the like, can be stored. It is also possible to store operation parameters or the like in the HDD 115.

The DRAM control IC 111 is also connected with a write processing unit 117. The write processing unit 117 is connected with the LD 151B of the printer unit 150, and performs processing of data used for operation of the LD 151B. Further, the printer unit 150 includes a printer control unit 152 which controls the entire printer unit 150, and the printer control unit 152 is connected with the control CPU 110 and is controlled by it.

In the controller 160, a DRAM control IC 161 is connected with an image memory 162 configured of DRAM or the like. Further, in the controller 160, the DRAM control IC 161, a controller control CPU 163 which controls the entire controller 160, and a LAN interface 165 are connected with a common bus. The LAN interface 165 is connected with the LAN 3.

Further, the control CPU 110 is connected with a communication control unit 121 which controls the entire communication unit 120 which performs communication with the outside, and is able to be connected with the network 4 such as LAN through an NIC 122 (network interface card) included in the communication unit 120. The communication control unit 121 operates with an operation order by the control CPU 110, sends data such as image information, instruction information, and image quality parameters, received from the control CPU 110 according to a predetermined communication procedure, to the network 4 via the NIC 122, and receives data such as image information and instruction information, sent from the network 4, via the NIC 122, and sends it to the CPU 110.

Although not shown, it is acceptable that a management device is connected with the network 4 and that the image formation apparatus 1 is managed by the management device. It should be noted that the present invention may not include a management unit. In that case, if a management device controls formation of a sheet gap image in a sheet gap or the like, a control unit included in the management device corresponds to the control unit of the present invention.

Further, the CPU 110 is connected with the sheet tilt detection unit 18 in a controllable manner, and the CPU 110 is able to control operation of the sheet tilt detection unit 18, receive a result detected by the sheet tilt detection unit 18, and determine a tilt of a sheet conveyed through the conveyance path 13.

Further, a tilt of a sheet may be detected not based on a detection result by the sheet tilt detection unit 18 but based on tilt information determined in advance according to a sheet feed tray or a sheet type. The tilt information can be stored in a nonvolatile memory provided to the control unit. This is because a tilt of a sheet may depend on a sheet feed tray or a sheet type. Accordingly, a preset value may be determined according to each sheet feed tray or each sheet type.

The control CPU 110 is able to acquire sheet tilt information from a detection result or preset information, and correct a turning angle of an image to be written in the image formation unit 151. The amount of correction is temporarily stored in the correction amount storing unit 113. It should be noted that turning of an image to be written may be set when the turning angle of a sheet is a predetermined value or more. Alternatively, it is also possible to set whether or not to turn it in advance, and according to the setting, determine whether or not to turn it by the control unit. The setting can be stored in a nonvolatile memory included in the control CPU 110, for example.

Next, basic operation of the image formation apparatus 1 will be described.

First, a procedure of accumulating image information in the image formation apparatus 1 will be described.

In the image formation apparatus 1, in the case of reading an image of a document by the scanner unit 130 and generating image information, an image of a document is optically read by the CCD 131 from the document in the scanner unit 130. At this moment, the scanner control unit 132, which receives an order from the control CPU 110, performs operation control of the CCD 131. The image read by the CCD 131 is applied with data processing by the read processing unit 116, and the image information, on which data processing is performed, is stored in the image memory 114 and the HDD 115 via the DRAM control IC 111. The image information and print information, stored in the image memory 114 or the HDD 115, is managed as a job by the control CPU 110.

In the case of acquiring image information and print information from the outside, job information transmitted from the terminal (PC) 5 via the LAN 3 is stored in the image memory 162 by the DRAM control IC 161 via the LAN interface 165, for example.

The print data in the image memory 162 is stored, according to control by the controller control CPU 163 in the controller 160, in the image memory 114 and the HDD 115 via the DRAM control IC 161, a PCI bus 112, and the DRAM control IC 111. In the case where the print data is page description data, the print image can be raster image through RIP processing by the controller control CPU 163.

Further, image information and print information can be acquired from a management device or another image formation apparatus via the NIC 122. Job information is stored temporarily in the image memory 114 and the HDD 115 via the DRAM control IC 111.

The image information stored in the image memory 114 is compressed via the DRAM control IC 111, and is stored in the image memory 114 via the DRAM control IC 111. When storing it in the HDD 115, it is compressed via the DRAM control IC 111 and is stored in the HDD 115. The job information is managed by the control CPU 110, similar to the above-described case. In job management, print conditions are set, and are stored in the image memory 114 and the HDD 115 in association with the image information.

The print conditions include a print mode, sheet information, a sheet feed tray, ejection destination, a post processing condition, and the like. Specifically, the print conditions include the number of pixels of an output image, color/monochrome, single/duplex, color tone adjustment, sheet size, sheet orientation, sheet type (paper type, weight, sheet color, etc.), selection of a sheet feed tray, presence/absence of alignment in the post processing device, presence/absence of cutting, and the like.

It should be noted that the print conditions may be set by a user via the operation unit 140, or automatically set by the control unit according to the initial setting or operation status.

In the case of performing image output by the image formation apparatus main body 10, that is, in the case of using it as a copier or a printer, when print data stored in the image memory 114 is used, the image information is processed to extend data via the DRAM control IC 111. When image information stored in the HDD 115 is used, the print data in the HDD 115 is processed to extend data via the DRAM control IC 111. The extended image information is sent to the write processing unit 117, and according to the print information associated with the image information, writing to the photoreceptor 151A is performed in the image formation unit 151.

In the printer unit 150, the printer control unit 152, which receives an order from the control CPU 110, controls the respective units. In that case, print conditions are referred to, and control is performed based on the contents thereof. In the image formation unit 151, a sheet gap image written on each photoreceptor at a writing position designated by the control CPU 110 is transferred to a sheet fed by the sheet feed tray 12, and is fixed by the fixing device 151C. In the photoreceptor 151A, remaining toner is removed by a cleaning unit not shown. The sheet is ejected to the downstream side through the conveyance path 13. Further, in the case of performing duplex printing, the sheet, after passing through the fixing device 151C, is sent to the reverse conveyance path 17, is reversed by the reverse conveying unit 16, and then is returned to the conveyance path 13 on the upstream of the photoreceptor 151A, whereby an image is formed on the back face side. Further, the printer control unit 152 is connected with the FNS control unit 200 of the post processing device 20 in a controllable manner. A post processing order by the control CPU 110 is transmitted to the FNS control unit 200 via the printer control unit 152, and the post processing unit is controlled via the FNS control unit 200.

The sheet, on which an image is printed by the image formation unit 151, passes through the conveyance path 13 and is sent to the post processing device 20, and is conveyed through the conveyance path 21 in the post processing device.

It should be noted that when an image is written on the photoreceptor 151A, writing is performed at a position according to the position reference of a sheet. Further, in the case where turning correction of an image to be written is needed, a turned image is written. The turning amount is stored in the correction amount storing unit 113, and the control CPU 110 causes the image to be written to turn according to the turning amount of the correction amount storing unit 113. In the correction amount storing unit 113, a tilt amount set in advance according to a sheet feed tray or a sheet, and a tilt angle detected by the sheet tilt detection unit 18 are stored. Regarding a sheet feed tray or a sheet, it is possible to grasp a tilt of a sheet in advance, and when a tilt is caused according to such tendency, use the preset amount.

Further, determination of an image writing angle may be controlled by the control CPU 110 included in the image formation apparatus 1, or controlled by a management device connected with the image formation apparatus.

Further, in the image formation apparatus 1 of the present embodiment, a sheet gap image can be formed in a sheet gap between sheets. Although an object of a sheet gap image is not limited particularly, there is an image correction patch in which a patch is printed on a sheet and the patch of the output image is detected by a color density sensor or the like and is compared with print base data, and when there is a difference, printing density or the like is corrected to form an image. There is also a calibration patch used for calibrating a density sensor by reading a toner image formed on an image bearing member, for example. Further, there is also a toner consumption patch for disposal of old toner.

When conveying a sheet, a conveying speed and a size in the sub scanning direction of a sheet are grasped by the control unit. As such, a sheet gap between sheets is also grasped by the control unit. The sheet gap image is drawn on an image bearing member such that image formation is performed in the sheet gap. Further, in the case where the sheet gap image is allowed to be formed in a margin region of the sheet, such a region may be included.

Figure 3:
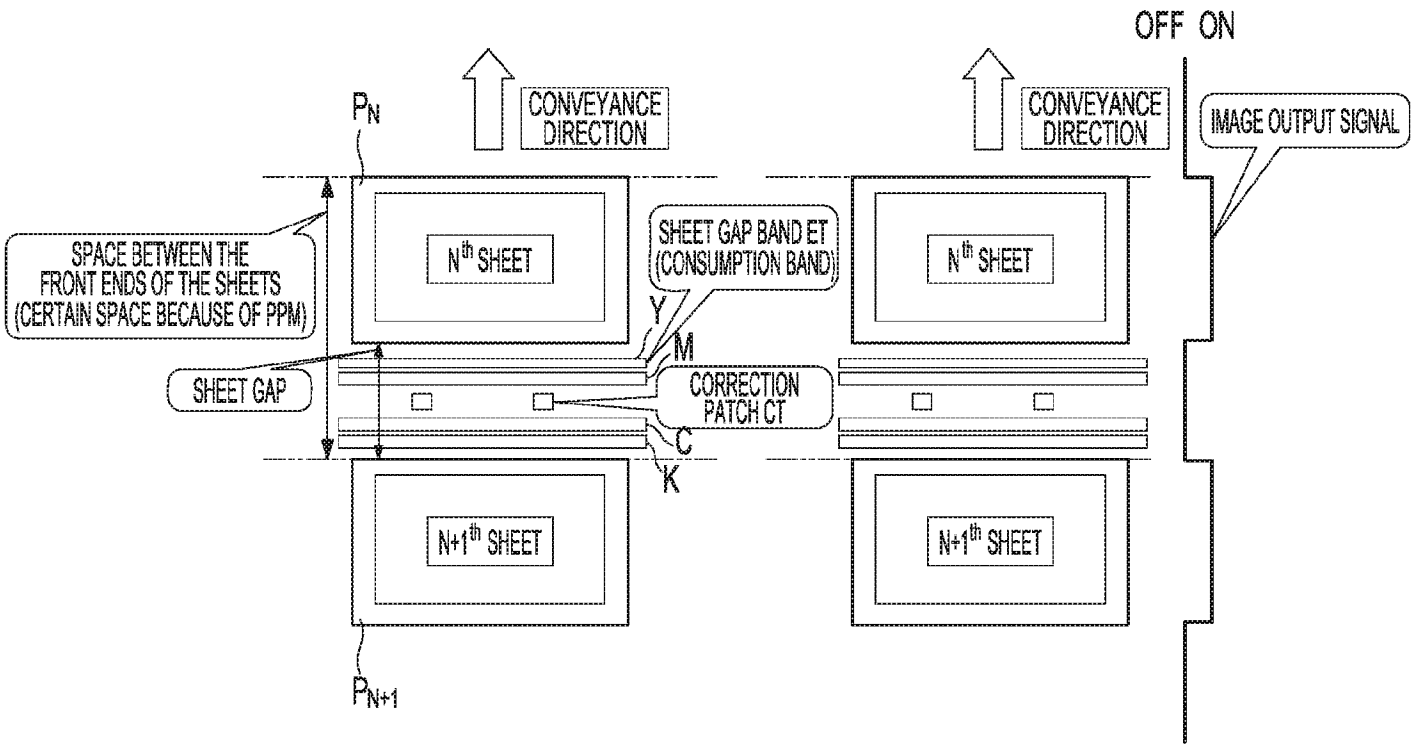
FIG. 3 illustrates a state of conveying sheets according to the embodiment of the present invention.

FIG. 3 illustrates a state of forming a sheet gap image in a sheet gap.

As shown in the left drawing, the $N^{th}$ sheet $P_N$ and the $N+1^{th}$ sheet $P_{N+1}$ have a certain space between the front ends of the sheets according to a predetermined PPM (paper per minute), and according to it, the sheets have a certain sheet gap.

As formation of a sheet gap image, in this embodiment, a plurality of consumption bands ET and a plurality of correction patches CT in a sheet gap are formed. Consumption bands ET are formed in a plurality of band shapes for the respective colors to consume a large amount of toner members, and are formed at a position close to the rear end side of the sheet $P_N$ and the front end side of the sheet $P_{N+1}$. Correction patches CT are formed to be interposed between the consumption bands ET. The correction patches CT are formed at locations detected by a density sensor not shown. In this embodiment, from the rear end of the $N^{th}$ sheet $P_N$ to the side of the $N+1^{th}$ sheet $P_{N+1}$, consumption bands ET for yellow (Y) and magenta (M) are formed, and behind the correction patches CT for yellow (Y) and magenta (M), consumption bands for cyan (C) and black (K) are formed on a further rear side.

The area (sub scanning direction width) of a consumption band varies according to the content printed on a sheet. For example, when image data of low density is printed, the length in the sub scanning direction of the band is increased.

Further, regarding an output of an image formed on a sheet, signals are output along the image formation range on the sheet. In a sheet gap, the position of a sheet gap image is controlled with an image output signal being turned off as a trigger. A sheet gap patch is drawn between images. As such, by using termination of a signal of a previous image data as a signal serving as a trigger of drawing a patch, the patch can be drawn without affecting the previous sheet.

Figure 4:
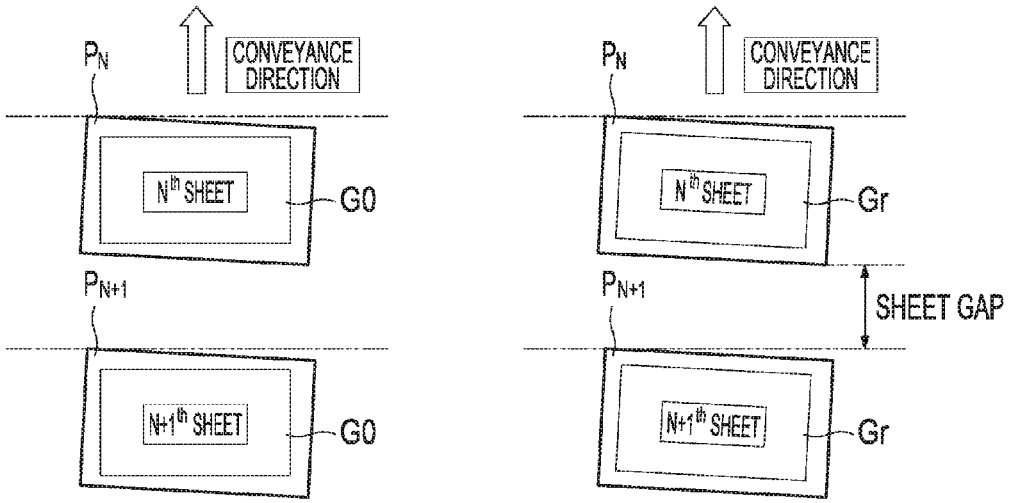
FIG. 4 illustrates a state where a sheet is tilted and cases of turning or not turning an image according to the embodiment of the present invention.

Further, regarding conveyance of a sheet, FIG. 4 illustrates a state where a sheet is conveyed in a tilted manner as described above.

As shown in the left drawing of FIG. 4, while respective sheets are conveyed such that a distance between the front ends of the sheets keeps a certain distance according to predetermined PPM, when a sheet is tilted, a sheet gap between the $N^{th}$ sheet $P_N$ and the $N+1^{th}$ sheet $P_{N+1}$ is decreased. Further, as a sheet is tilted, an image G0 formed on the sheet is drawn in a tilted state relative to the sheet.

Further, as shown in the right drawing of FIG. 4, when writing an image, it is possible to write the predetermined image G0 on a transfer medium by turning it. In that case, a turned image Gr is drawn at a proper angle relative to the sheet.

Figure 5:
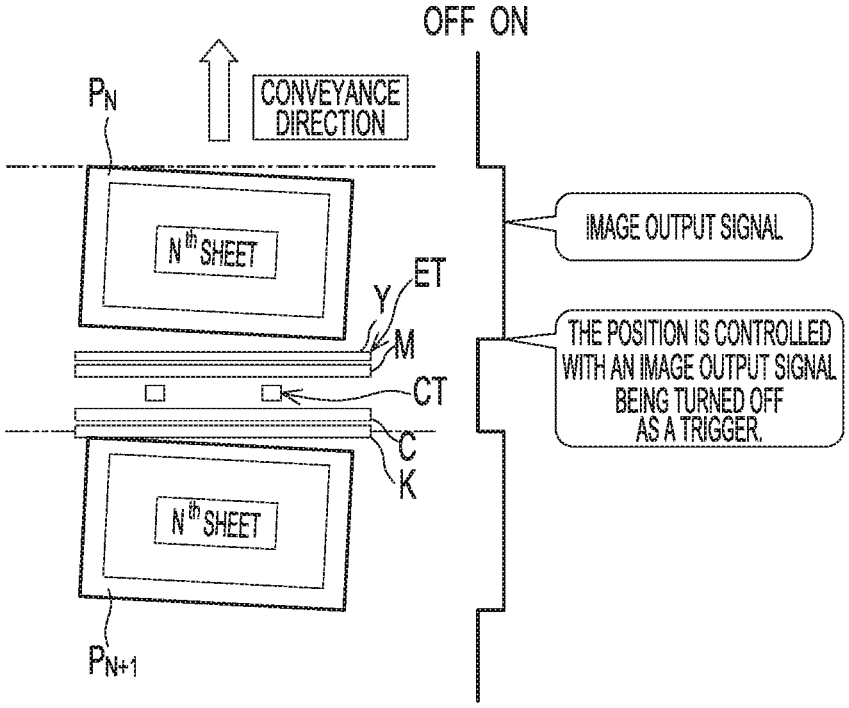
FIG. 5 illustrates a problem when a sheet is tilted and a sheet gap image is formed between sheets in a conventional example.

As described above, in the case of forming a consumption band ET or a correction patch CT in a sheet gap between tilted sheets, if the timing of turning off an image output signal is used as a trigger as shown in FIG. 5, the timing of forming a consumption band ET or a correction patch CT deviates. This may cause a problem that the patch position of a correction patch CT deviates or the rear side of a consumption band ET overlaps the sheet $P_{N+1}$, for example. As such, it is impossible to form a sheet gap image of a required amount in a sheet gap.

Further, even in the case of not performing turning correction of an image, a sheet gap image may overlap the sheet region.

A sheet gap patch, a band, or the like is made every predetermined number of sheets (every 10 prints, for example). Setting for outputting a sheet gap patch or a band can be made during outputting of an image of the previous sheet (during the output signal is on) at the latest. The length of a sheet gap (from the head of a sheet to the head of the subsequent sheet) is determined from a linear velocity and printing performance (PPM). For example, in the case of printing an A4 sheet at 120 PPM, 60 (sec)/120 (sheets)=0.5 (sec/sheet), whereby it is necessary to start printing every 0.5 seconds.

In the case where the linear velocity is 500 mm/sec, as a sheet of 250 mm is conveyed in 0.5 seconds, a sheet gap is 250 mm-210 mm (length of A4 sheet)=40 mm.

As such, a sheet gap patch and a band are designed to be made within 40 mm.

Further, in the present embodiment, when a sheet to be conveyed is tilted, it is possible to calculate a sheet gap changed by the tilt.

Regarding turning correction of an image, by recording a correction amount (angle) with respect to each tray, an image signal length can be calculated from the correction amount of a tray at the time of output. Further, a tilt of a sheet can be obtained from a detection result by the sheet tilt detection unit 18.

Figure 6:
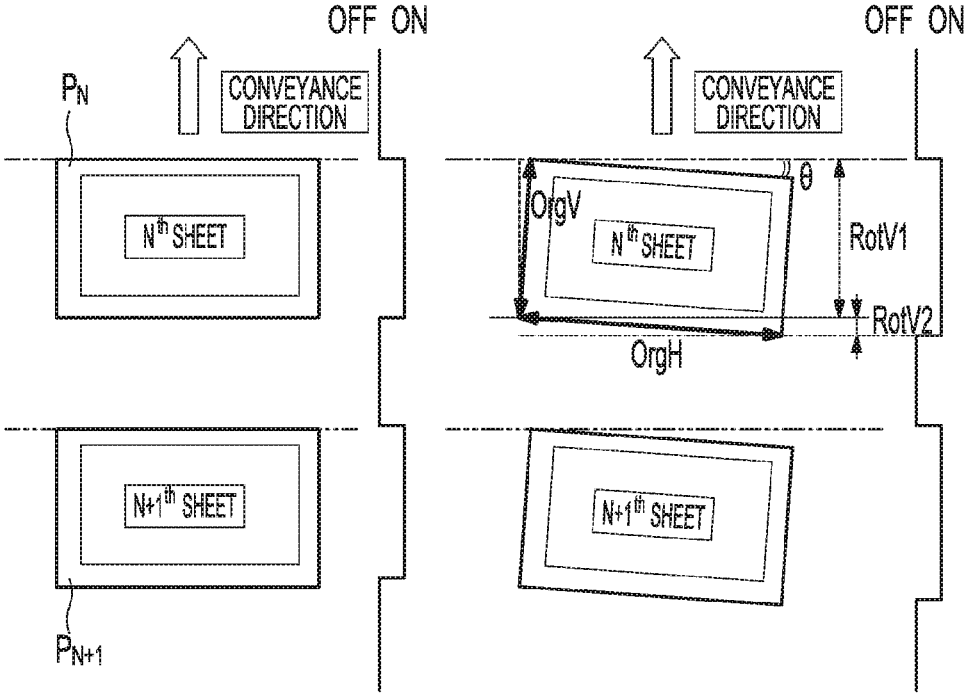
FIG. 6 illustrates calculation of a sheet gap when a sheet is tilted according to the embodiment of the present invention.

An image signal length (RotV1+RotV2) after correction can be obtained as follows:

$$Rot1=OrgV\times\cos\theta, Rot2=OrgH\times\sin\theta \text{(FIG. 6)}$$

where OrgV represents a sheet sub scanning length, OrgH represents a main scanning direction length, and θ represents a correction angle.

A correction angle θ, set in advance, can be acquired by outputting a dedicated chart (for example, cross corner marks are printed at four corners) from a tray for checking the angle and manually measuring the angle from the sheet edge, or calculating it by reading the chart by a scanner. The acquired angle can be recorded on a correction record unit or the like.

When the correction angle is 1 degree, a distance at a sheet edge in the length direction is 215.15 mm whereby an image signal length is increased by about 5 mm and a region where a sheet gap patch and a band can be drawn is decreased by 5 mm.

Figure 7:
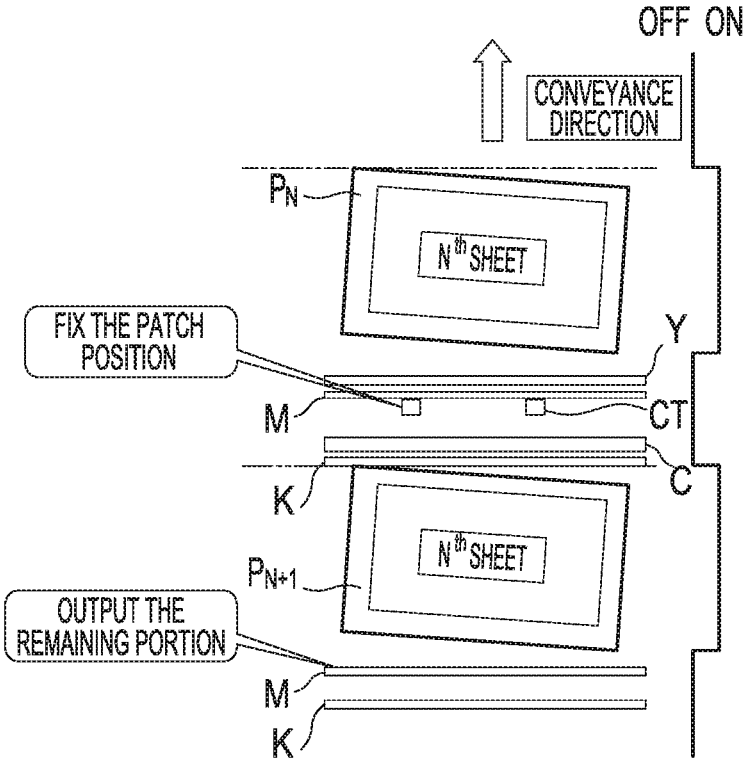
FIG. 7 illustrates a mode of forming a portion of a sheet gap image to be formed in a sheet gap in the next sheet gap, according to the embodiment of the present invention.

In this example, a region where a sheet gap patch and a band can be drawn is able to be calculated from a turning correction amount, a sheet size, and a linear velocity, and the sizes of a patch and a band to be drawn is able to be calculated before drawing from the printed content. As such, if they cannot be made within the region, it is possible to draw only a portion which can be drawn, and draw the remaining portion in the next sheet gap. It should be noted that in order to keep good balance or divide it at an appropriate position, if the entire content cannot be made within the region, it is acceptable to draw a portion thereof in a narrower region than a region where drawing can be made, and draw the remaining portion in the next sheet gap. For example, as a patch position is read by a sensor as shown in FIG. 7, it is possible to draw consumption bands of yellow (Y) and cyan (C) without changing the position with respect to the sheet start position, and regarding the bands for magenta (M) and black (K), draw only a portion which can be drawn, and draw the remaining bands for magenta (M) and black (K) in the next sheet gap.

With such control, even in the case of performing turning correction, a sheet gap patch and a band of a required amount can be drawn first, without printing all of them in the next page. Thereby, sheet gap processing can be processed earlier. As the sheet gap processing affects the subsequent printing density, it is better to perform as soon as possible. Further, although it takes a longer time until the sheet gap processing ends, it is possible to omit calculation processing for those can be drawn in a sheet gap, which makes control easy.

Figure 8:
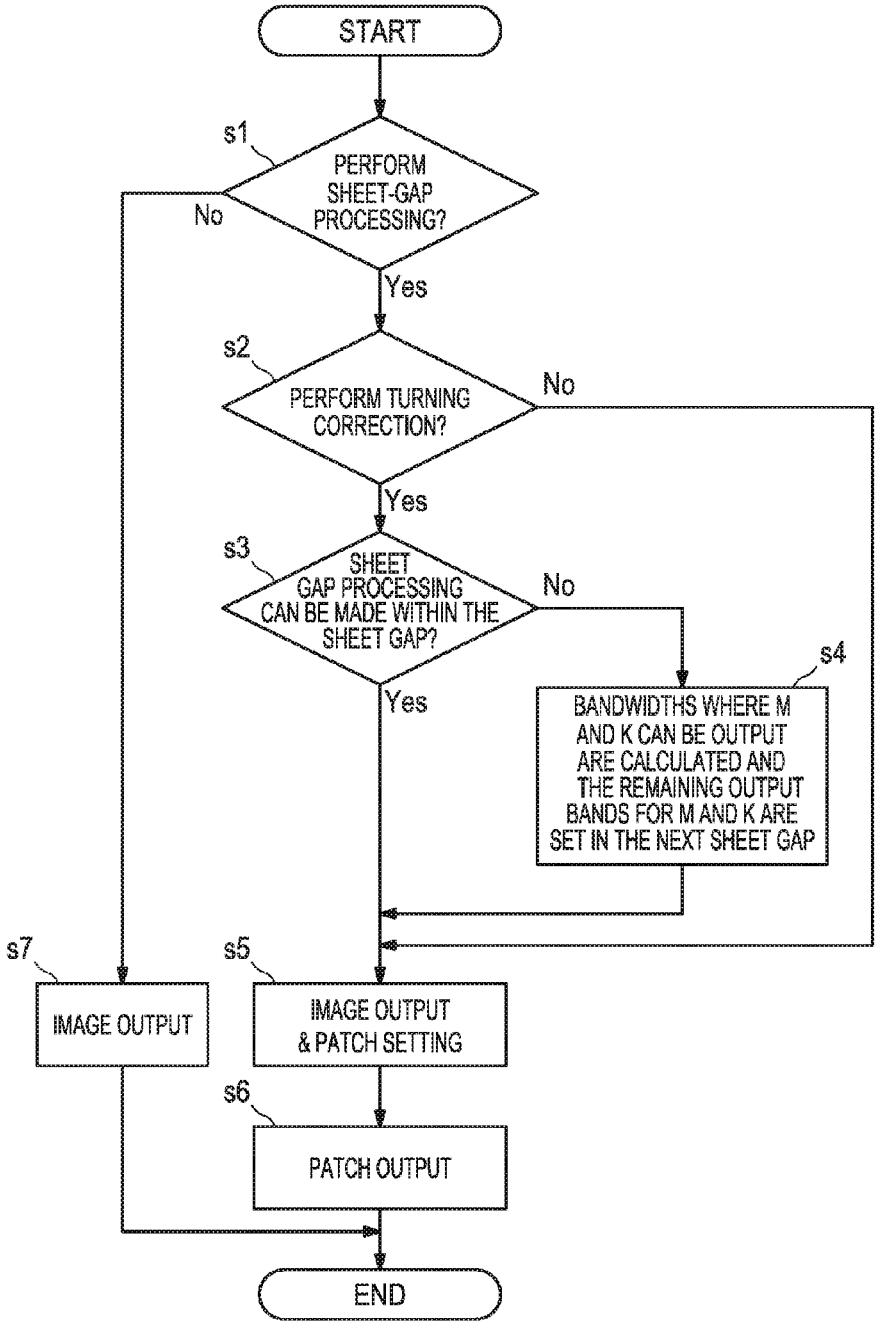
FIG. 8 is a flowchart showing a procedure of sheet gap processing to form a portion of a sheet gap image of a sheet gap in the next sheet gap, according to the embodiment of the present invention.

A procedure of the control as described above will be described based on the flowchart of FIG. 8. The following procedure is performed according to control by the control unit.

First, along with start of a printing process of a job, it is determined whether a setting of sheet-gap processing, that is, a process of forming a sheet gap image between sheets exists or not (step s1). It is possible to set whether or not to perform sheet gap processing in advance, and store it in a nonvolatile memory or the like of the control unit.

When there is no sheet gap processing (step s1, No), image output is performed (step s7), and the processing ends.

When the setting of sheet gap processing exists (step s1, Yes), it is determined whether or not to perform turning correction (step s2). Regarding turning correction, it is possible to set whether or not to perform turning correction by the setting, or it is also possible to perform turning correction when the sheet is turned by a predetermined amount or more.

When there is no turning correction (step s2, No), image output and patch setting are performed (step s5), patch output is performed (step s6), and the processing ends.

In the case of performing turning correction (step s2, Yes), it is determined whether or not sheet gap processing can be made within the sheet gap (step s3). It should be noted that while the flow of procedure is changed depending on whether or not to perform turning correction in this flowchart, step s3 can be performed regardless of presence or absence of turning correction. When there is no turning correction, a trigger when the image formation is turned off is never taken as a problem. However, there is a case where a sheet gap is decreased due to a tilt of the sheet, so that a toner image cannot be formed within the sheet gap. By performing step s3 regardless of presence or absence of turning correction, it is possible to prevent a toner image from being formed on a margin region.

When the sheet gap processing can be made within the sheet gap at step s3 (step s3, Yes), image output and patch setting are performed (step s5), and then patch output is performed (step s6), and the processing ends.

When the sheet gap processing cannot be made within the sheet gap (step s3, No), bandwidths where magenta (M) and black (K) can be output are calculated, and these consumption bands where output can be made and consumption bands for yellow (Y) and cyan (C) are set in the current sheet gap, and the remaining output bands for magenta (M) and black (K) are set in the next sheet gap (step s4) to perform image output and patch setting (step s5). Then, patch output is performed, and the processing ends.

Next, description will be given on a state of performing sheet gap processing while shifting it to a sheet gap where a sheet gap image of a required amount can be formed.

Figure 9:
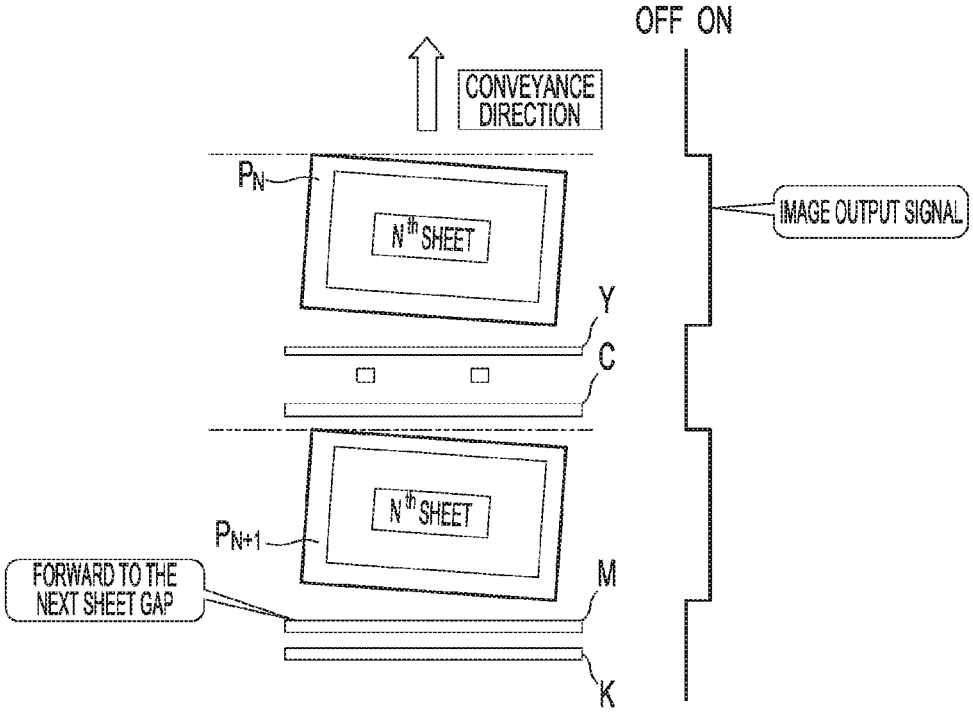
FIG. 9 illustrates a mode of forming a sheet gap image, to be formed in a sheet gap, in the next sheet gap, according to another embodiment of the present invention.

In FIG. 9, color bands of yellow (Y) and cyan (C) are drawn in the current sheet gap, while color bands of magenta (M) and black (K) are not formed in the current sheet gap but they are forwarded to the next sheet gap and are formed therein. Correction patches CT are drawn in the current sheet gap fixedly.

Figure 10:
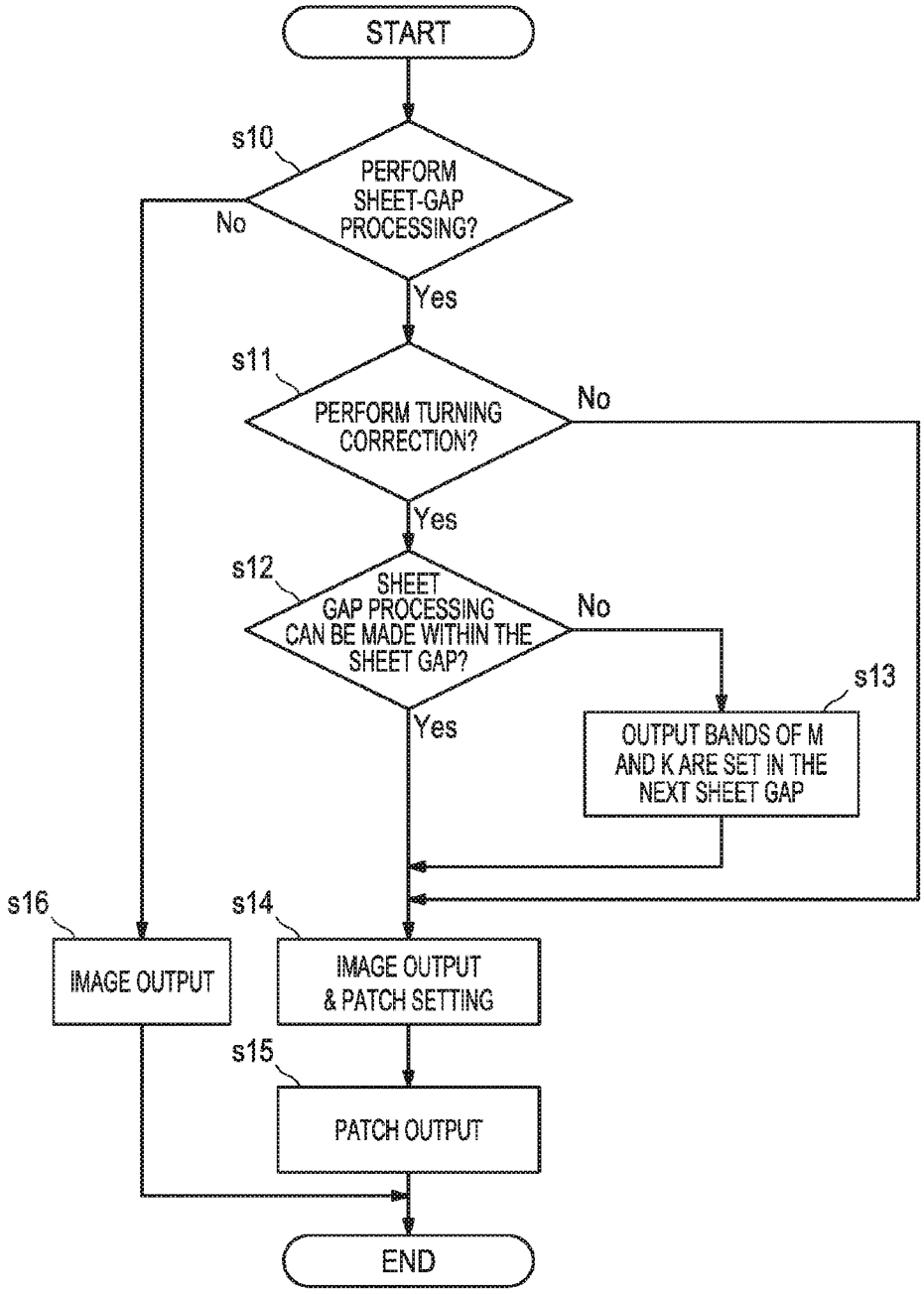
FIG. 10 is a flowchart showing a procedure of sheet gap processing to form a sheet gap image of a sheet gap in the next sheet gap, according to the embodiment of the present invention.

The procedure described above will be described based on the flowchart of FIG. 10. The procedure described below is performed according to control by the control unit.

First, along with start of a printing process of a job, it is determined whether or not to perform sheet-gap processing, that is, a process of forming a sheet gap image between sheets (step s10). It is possible to set whether or not to perform sheet gap processing in advance, and store it in a nonvolatile memory of the control unit.

When there is no setting of sheet gap processing (step s10, No), image output is performed (step s16), and the processing ends.

When the setting of sheet gap processing exists (step s10, Yes), it is determined whether or not to perform turning correction (step s11). When there is no turning correction (step s11, No), image output and patch setting are performed (step s14), patch output is performed (step s15), and the processing ends.

In the case of performing turning correction (step s11, Yes), it is determined whether or not sheet gap processing can be made within the sheet gap (step s12). It should be noted that while the flow of procedure is changed depending on whether or not to perform turning correction in this flowchart, step s12 may be performed regardless of presence or absence of turning correction.

When the sheet gap processing can be made within the sheet gap at step s12 (step s12, Yes), image output and patch setting are performed (step s14), and patch output is performed (step s15), then the processing ends.

When the sheet gap processing cannot be made within the sheet gap (step s12, No), yellow (Y) and cyan (C) are set in the current sheet gap, and output bands of magenta (M) and black (K) are set in the next sheet gap (step s13), and image output and patch setting are performed (step s14). Then, patch output is performed (step s15), and the processing ends.

Figure 11:
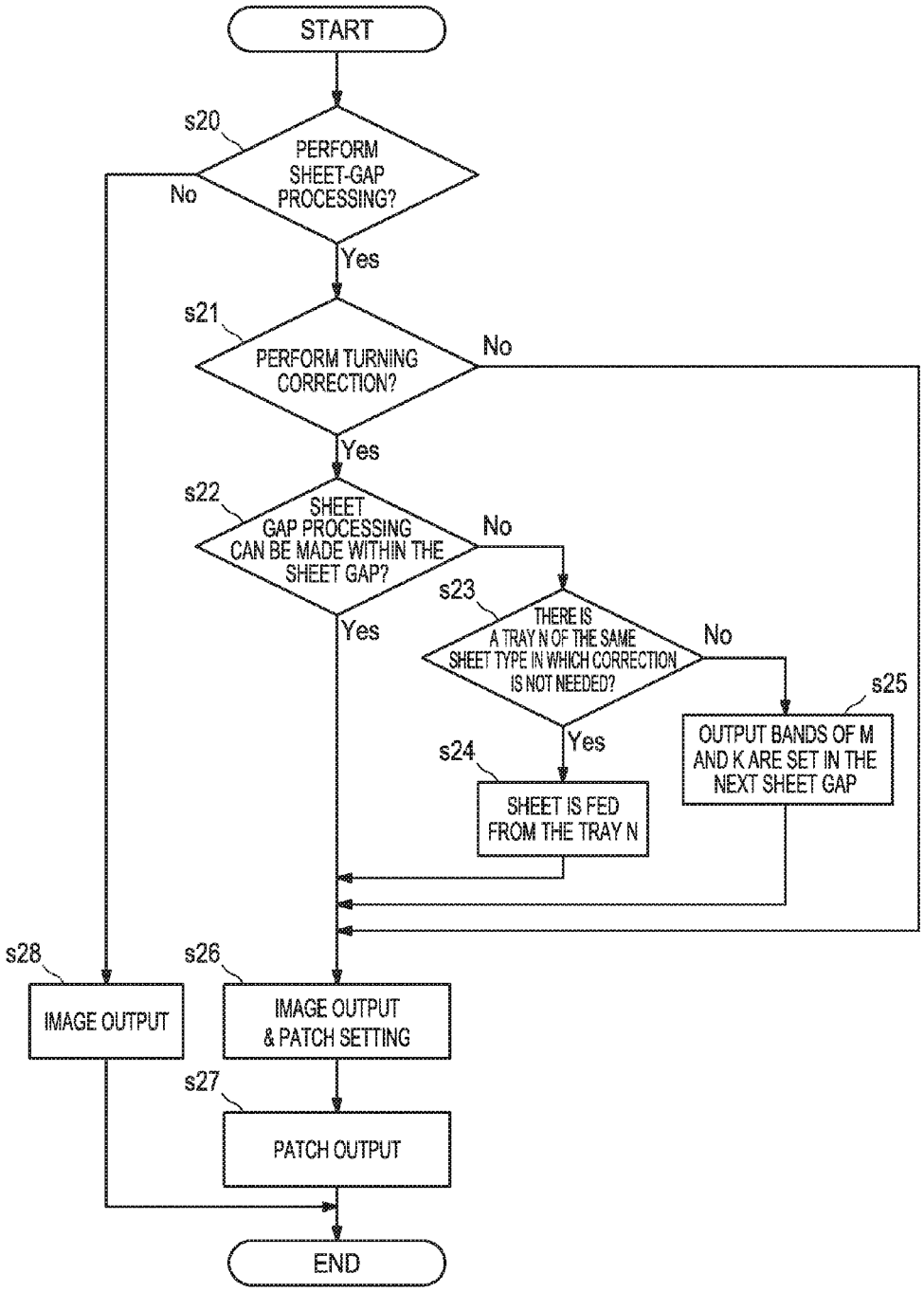
FIG. 11 is a flowchart showing a procedure of forming a sheet gap image in a sheet gap with use of a sheet of another tray, according to still another embodiment of the present invention.

Next, another procedure will be described based on the flowchart of FIG. 11. The following procedure is performed according to control by the control unit.

In this embodiment, it is possible to calculate whether or not there is a turning correction amount and whether or not required patches and bands can be drawn in the sheet gap, in advance. As such, when it is determined that there is not enough region for drawing required sheet gap patches and bands, it is determined whether or not there is a sheet which is the same (in size, sheet type, and the like) as the sheet being output in another tray n, and whether or not it is possible to draw required sheet gap patches and bands with the turning correction amount of the tray n.

First, along with start of a printing process of a job, it is determined whether a setting of sheet-gap processing exists or not, that is, a process of forming a sheet gap image between sheets (step s20). It is possible to set whether or not to perform sheet gap processing in advance, and store it in a nonvolatile memory or the like of the control unit.

When there is no setting of sheet gap processing (step s20, No), image output is performed (step s28), and the processing ends.

When the setting of sheet gap processing exists (step s20, Yes), it is determined whether or not to perform turning correction (step s21). When there is no turning correction (step s21, No), image output and patch setting are performed (step s26), patch output is performed (step s27), and the processing ends.

In the case of performing turning correction (step s21, Yes), it is determined whether or not sheet gap processing can be made within the sheet gap (step s22). It should be noted that while the flow of procedure is changed depending on presence or absence of turning correction in this flowchart, step s22 may be performed regardless of presence or absence of turning correction.

When the sheet gap processing can be made within the sheet gap at step s22 (step s22, Yes), image output and patch setting are performed (step s26), patch output is performed (step s27), and the processing ends.

When the sheet gap processing cannot be made within the sheet gap (step s22, No), it is determined whether or not there is a sheet feed tray n of the same sheet type in which correction of a sheet gap image is not needed (step s23). If there is a sheet feed tray n of the same sheet type in which correction of a sheet gap image is not needed (step s23, Yes), control of the sheet gap image is not performed, and a sheet is fed from the sheet feed tray n (step s24). Then, image output and patch setting are performed (step s26), patch output is performed (step s27), and the processing ends. With such control, it is possible to draw sheet gap patches and bands of a required amount without printing on the next page.

On the other hand, if there is no sheet feed tray n of the same sheet type in which correction of a sheet gap image is not needed (step s23, No), output bands of yellow (Y) and cyan (C) are set in the current sheet gap and output bands of magenta (M) and black (K) are set in the next sheet gap (step s25), and image output and patch setting are performed (step s26). Then, patch output is performed (step s27), and the processing ends.

As such, according to the present embodiment, even in the case where a transfer medium, on which an image is formed, is tilted, it is possible to form a sheet gap image of a required amount in a sheet gap between transfer media.

Although the present invention has been described and illustrated in detail, it is clearly understood that the same is by way of illustrated and example only and is not to be taken by way limitation, the scope of the present invention being interpreted by terms of the appended claims.

What is claimed is:

1. An image formation apparatus comprising:

an image formation unit that forms an image on a transfer medium;

a conveyance unit that conveys the transfer medium; and a control unit that controls formation of the image and conveyance of the transfer medium, wherein the control unit has a sheet gap image forming function of forming a predetermined sheet gap image in a sheet gap between the transfer media conveyed by the conveyance unit, and when the transfer medium is conveyed, the control unit acquires information of a tilt angle on a conveyance surface of the transfer medium conveyed to the image formation unit, and based on the tilt angle, calculates a sheet gap between the transfer media, and when performing the sheet gap image forming function, determines whether or not a sheet gap image of a required amount is able to be formed in the sheet gap.

2. The image formation apparatus according to claim 1, wherein the control unit controls formation of the sheet gap image based on a result of the determination.

3. The image formation apparatus according to claim 1, wherein the control unit has an image turning correction function of forming an image to be written, to be formed on the transfer medium, on the transfer medium by tilting the image according to the tilt angle of the transfer medium.

4. The image formation apparatus according to claim 1, wherein the control unit determines timing to start writing of the sheet gap image according to a state where an output signal of the image, to be formed on the transfer medium, is turned off.

5. The image formation apparatus according to claim 1, wherein when the control unit determines, in the determination, that the sheet gap image of the required amount is not able to be formed in the sheet gap, the control unit forms the sheet gap image of an amount capable of being formed in the sheet gap or less in the sheet gap, and forms the sheet gap image of at least an amount incapable of being formed in the sheet gap, in a next or subsequent sheet gap.

6. The image formation apparatus according to claim 1, wherein when the control unit determines, in the determination, that the sheet gap image of the required amount is not able to be formed in the sheet gap, the control unit forms the sheet gap image in a next or subsequent sheet gap where the sheet gap image of the required amount is able to be formed.

7. The image formation apparatus according to claim 1, wherein when the control unit determines, in the determination, that the sheet gap image of the required amount is not able to be formed in the sheet gap, the control unit determines whether there is a transfer medium, same as the transfer medium being fed, in another sheet feed device, and whether the sheet gap image of the required amount is able to be formed in a gap provided by the other sheet feed device, and if it is possible, the control unit allows a transfer medium immediately before forming the sheet gap image to be fed from the other sheet feed device.

8. The image formation apparatus according to claim 1, wherein the control unit acquires information of a tilt angle, registered in advance, of a transfer medium to be conveyed.

9. The image formation apparatus according to claim 1, further comprising a tilt detection unit that detects a tilt angle of the sheet to be conveyed, wherein the control unit acquires information of the tilt angle based on a detection result by the tilt detection unit.

10. The image formation apparatus according to claim 1, wherein the sheet gap image is a toner consumption patch or/and a correction patch.

11. The image formation apparatus according to claim 1, wherein the control unit calculates a sheet gap between the transfer media based on the tilt angle for each type of a transfer medium or each feed device that feeds a transfer medium.

12. An image formation method comprising:

acquiring information of a tilt angle on a conveyance surface of a transfer medium conveyed for image formation;

calculating a sheet gap between the transfer media based on a space between sheets of the transfer media set in advance, and the tilt angle; and in sheet gap image formation of forming a predetermined sheet gap image between the sheets of the transfer media, determining whether or not the sheet gap image of a required amount is able to be formed in the sheet gap.

13. The image formation method according to claim 12, further comprising:

changing setting of the sheet gap image formation based on a result of the determination.

14. The image formation method according to claim 12, further comprising:

performing turning correction to turn an image to be written of the image according to the tilt angle.

15. A non-transitory computer-readable recording medium storing an image formation program to be executed by a control unit that controls a conveyance unit to convey a transfer medium and controls an image formation unit to form an image on the transfer medium, the image formation program comprising:

a sheet gap image formation step of forming a predetermined sheet gap image in a sheet gap between the transfer media by the image formation unit;

a step of acquiring information of a tilt angle on a conveyance surface of the transfer medium conveyed by the conveyance unit and on which the image is formed;

a step of calculating the sheet gap between the transfer media based on the tilt angle; and a determination step of determining whether or not the sheet gap image of a required amount is able to be formed in the sheet gap in the sheet gap image formation step.

16. The non-transitory computer-readable recording medium storing the image formation program according to claim 15, the image formation program further comprising a sheet gap image formation changing step of changing a writing position of forming the sheet gap image based on a result of the determination.

17. The non-transitory computer-readable recording medium storing the image formation program according to claim 15, the image formation program further comprising an image turning step of performing turning correction to turn an image to be written by the image formation unit according to the tilt angle.

* * * * *